US006071688A

United States Patent [19]

Moose et al.

[11] Patent Number: 6,071,688

[45] Date of Patent: Jun. 6, 2000

[54] PROVIDING ADDITIVES TO A COATING COMPOSITION BY VAPORIZATION

[75] Inventors: Scott C. Moose, Victor; Charles L. Bauer, Webster; Gregory W. Keyes, Rochester, all of N.Y.

[73] Assignee: Eastman Kodak Company, Rochester, N.Y.

[21] Appl. No.: 09/124,690

[22] Filed: Jul. 29, 1998

[51] Int. Cl.[7] ..... G03C 1/015; G03C 1/38

[52] U.S. Cl. ..... 430/631

[58] Field of Search ..... 430/935, 631, 430/617, 629, 512

[56] References Cited

U.S. PATENT DOCUMENTS

| | | | |
|---|---|---|---|
| 1,870,354 | 8/1932 | Brunken . | |
| 2,080,019 | 5/1937 | White | 95/7 |
| 2,240,472 | 4/1941 | Swan | 95/7 |
| 2,271,623 | 2/1942 | Carroll | 95/7 |
| 2,288,226 | 6/1942 | Carroll et al. | 95/7 |
| 2,726,162 | 12/1955 | Allen et al. | 106/125 |
| 2,739,891 | 3/1956 | Knox, Jr. | 117/34 |
| 2,823,123 | 2/1958 | Knox, Jr. | 96/94 |
| 2,831,766 | 4/1958 | Knox et al. | 96/94 |
| 2,870,013 | 1/1959 | Jeffrey | 96/100 |
| 2,944,900 | 7/1960 | Carroll et al. | 96/100 |
| 2,983,611 | 5/1961 | Allen et al. | 96/111 |
| 2,992,109 | 7/1961 | Allen | 96/111 |
| 3,047,394 | 7/1962 | Allen et al. | 96/111 |
| 3,057,723 | 10/1962 | Jeffreys | 96/99 |
| 3,068,101 | 12/1962 | Knox, Jr. et al. | 96/94 |
| 3,103,437 | 9/1963 | Henn et al. | 96/111 |
| 3,133,816 | 5/1964 | Ben-Ezra | 96/94 |
| 3,158,484 | 11/1964 | Willems et al. | 96/107 |
| 3,210,191 | 10/1965 | Willems et al. | 96/107 |
| 3,232,764 | 2/1966 | Allen et al. | 96/111 |
| 3,253,919 | 5/1966 | Beavers et al. | 96/50 |
| 3,294,540 | 12/1966 | Goffe | 96/87 |
| 3,321,313 | 5/1967 | Burness et al. | 96/111 |
| 3,325,287 | 6/1967 | Yamamoto et al. | 96/111 |
| 3,362,827 | 1/1968 | Oishi et al. | 96/111 |
| 3,415,649 | 12/1968 | Nishio et al. | 96/94 |
| 3,441,413 | 4/1969 | Nishio et al. | 96/94 |
| 3,475,174 | 10/1969 | Sato et al. | 96/94 |
| 3,507,660 | 4/1970 | Nishio et al. | 96/114.5 |
| 3,539,644 | 11/1970 | Burness et al. | 260/607 |
| 3,543,292 | 11/1970 | Burness et al. | 96/111 |
| 3,545,974 | 12/1970 | Nishio et al. | 96/114.5 |
| 3,589,906 | 6/1971 | McDowell | 96/87 |
| 3,607,291 | 9/1971 | Knox, Jr. | 96/114.5 |
| 3,666,478 | 5/1972 | Groh et al. | 96/114.5 |
| 3,671,247 | 6/1972 | Yoneyama et al. | 96/66.3 |
| 3,726,683 | 4/1973 | Yamamoto et al. | 96/84 A |
| 3,754,924 | 8/1973 | DeGeest et al. | 96/114.2 |
| 3,756,828 | 9/1973 | Yoneyama et al. | 96/87 A |
| 3,772,021 | 11/1973 | Yoneyama et al. | 96/66.3 |
| 3,819,608 | 6/1974 | Yamamoto et al. | 260/117 |
| 3,843,368 | 10/1974 | Yamamoto et al. | 96/67 |
| 3,847,948 | 11/1974 | Yamamoto et al. | 26/340.3 |
| 4,004,927 | 1/1977 | Yamamoto et al. | 96/67 |
| 4,094,269 | 6/1978 | Malinovski et al. | 118/49.1 |
| 4,218,533 | 8/1980 | Fuchigami et al. | 430/512 |
| 4,528,371 | 7/1985 | Coates et al. | 544/239 |
| 4,954,371 | 9/1990 | Yialixia | 427/44 |
| 5,236,739 | 8/1993 | Chou et al. | 427/146 |
| 5,543,640 | 8/1996 | Sutherland et al. | 257/202 |

FOREIGN PATENT DOCUMENTS

| | | |
|---|---|---|
| 676628 | 7/1952 | United Kingdom . |
| 860323 | 2/1961 | United Kingdom . |
| 1012495 | 12/1965 | United Kingdom . |
| 1022878 | 3/1966 | United Kingdom . |
| 1138514 | 1/1969 | United Kingdom . |
| 1159825 | 7/1969 | United Kingdom . |
| 1179290 | 1/1970 | United Kingdom . |
| 1198450 | 7/1970 | United Kingdom . |
| 1374780 | 11/1974 | United Kingdom . |
| 1397218 | 6/1975 | United Kingdom . |
| 1477409 | 6/1977 | United Kingdom . |

*Primary Examiner*—Thorl Chea

*Attorney, Agent, or Firm*—Arthur H. Rosenstein; Mark G. Bocchetti

[57] ABSTRACT

An additive is added to a coating composition on a support by vaporizing the additive on to the coating composition. The additive preferably reacts with the coating composition in either the wet or dry state.

10 Claims, 1 Drawing Sheet

PROVIDING ADDITIVES TO A COATING COMPOSITION BY VAPORIZATION

FIELD OF THE INVENTION

This invention relates to a process for incorporating additives during the production of a coated substrate and more particularly to incorporating additives to a photographic and or a thermally processable imaging element.

BACKGROUND OF THE INVENTION

Generally a material, such as a photothermographic material is produced by coating a support with a light sensitive silver halide composition, such as a silver halide-organic silver salt-polymer emulsion, and (or) with a coating solution for a non-light sensitive layer, (either to be referred to hereinafter generically as a "coating composition"), and drying the coating. The general practice is to incorporate various additives in the coating composition during its preparation. Some types of additives, however, may react with the polymer binder or other chemicals in the coating composition, and will adversely affect the properties of the coating composition or of the coatings. These include the photographic characteristics of the imaging element, the Theological behavior of the coating solution and the physical properties of the coated layer, such as reticulation, adhesion, melting point, abrasion resistance, wet-ability, anti-static properties etc. When such additives are used, the coating composition must be applied immediately after the preparation of the coating composition in order to avoid adverse effects. This imposes a restriction on the use of fast-acting additives. Furthermore, according to this practice, an additive whose distribution should desirably be controlled in a particular area, for example a surface modifier such as anti-static agents, lubricants, etc. which should desirably be distributed and concentrated near the surface of the coating, are difficult to incorporate in such a manner as to achieve the desired distribution.

For many applications, the coating additives are incorporated directly into the coating solution and then coated onto various supports. For photographic or (photo)thermographic materials, "hardeners" or crosslinking materials may be used as additives in the coating solution to improve the properties of the dried coating composition. Many of these hardeners are fast acting additives and basically react before the solution can be coated. When this occurs, the additives can adversely affect the coating solution (viscosity, wet-ability, etc.) or product properties (adhesion, melting point, abrasion resistance).

In U.S. Pat. No. 4,218,533 to Fuji, a process of by which coating additives (such as hardeners) are applied independently of the coating solution is discussed. The additives are added via atomization due to ultrasonic vibration. The atomization process generates small droplets which are essentially sprayed onto the wet coated surface. Once the droplets come in contact with the wet coated surface, they begin to react.

The benefits of atomization are: 1) it removes defects associated with the general methodology of incorporating fast acting additives, 2) it increases batch life by keeping additives out of the coating solution prior to application and, 3) it provides capability of incorporating additives in a desired localized or limited area.

The limitations of the prior art method are primarily that the droplets will cause surface disruptions (thus defects) when sprayed directly onto the surface of the wet (undried) coating surface and uniform distribution of the spray across the web. In many instances, the additive must be added to the wet coating surface in order for the additive to be effective (i.e. it needs to react with the wet solution). The patent also describes applying the additive after the surface is dried to eliminate the surface disruptions caused by the spraying, but this may limit the reactivity of the additive.

Agfa U.S. Pat. No. 5,443,640 describes the use of applying atomized droplets to form a thin antistatic layer on a dried surface of a coating. It also describes a process for controlling the droplet flow which requires special air flow handling stations. This patent does not teach the use of reactive materials in the process.

It is known in the art, that many different materials can be applied to coatings and supports using vapor deposition such as in U.S. Pat. No. 5,236,739 (H.-H. Chou, et. al), U.S. Pat. No. 4,094,269 (Y. P. Malinovski, et. al) and U.S. Pat. No. 4,954,371 (A. Yialixis). Although reactive materials may be used, the methods described in these patents require vacuum, high temperature or both which is not desirable for a continuous coating process which uses organic solvents.

Fast reacting materials may also be incorporated into the composition by applying them in a multilayer coating format, such as a simultaneous slide layer. This requires the appropriate selection of coating solvents for all the layers to prevent phase separation. Although this method keeps the reactive additive away from the main coating elements, it typically generates increased waste due to defects such as lines, streaks and width-wide crosslines in the coating associated with the additional coating layer.

It would be considered highly advantages to be able to coat all kinds of additives uniformly to all kinds of coatings and to be able to coat either wet or dry coatings.

SUMMARY OF THE INVENTION

An object of this invention is to remove the defects of the conventional processes as described above to produce a coated material.

Another object of this invention is to provide a process permitting incorporation of fast acting additives into a coating composition without being limited to a specific period of time from the preparation of the coating composition to the coating of the coating composition.

Further another object of this invention is to provide a method whereby additives can be incorporated in the coating layer in a desired localized or limited area.

A still further object of this invention is to provide a method to add additives to all kinds of coatings and to either wet or dried coatings.

The objects of this invention are achieved by creating a vapor phase of the additive and applying said vapor to the wet or dried coating composition.

BRIEF DESCRIPTION OF THE DRAWINGS

Embodiments of the present invention are described below in detail by reference to the accompanying drawing in which.

Figure 1:
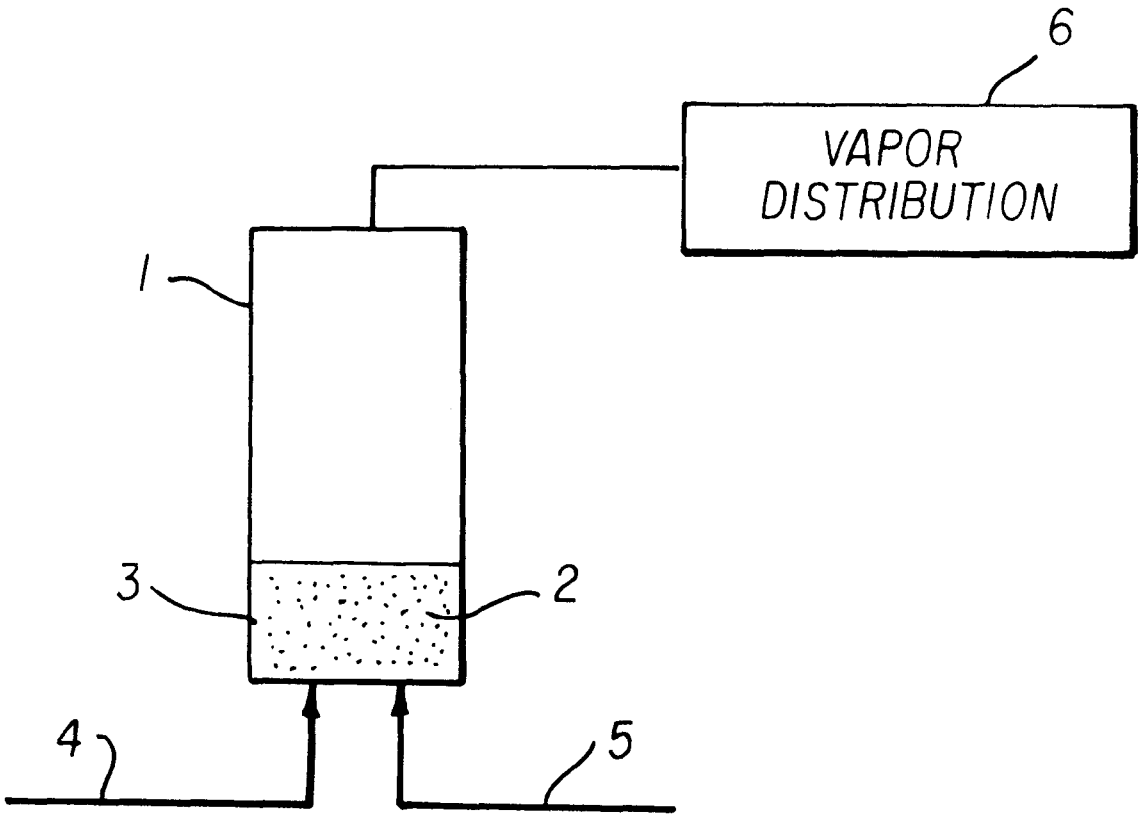
FIG. 1 is a drawing of a vaporization apparatus useful in this invention.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

The additive is added to the coating composition which typically comprises a polymer binder using the apparatus depicted in FIG. 1 where the liquid additive 4 is metered into the jacketed vessel 1 such that the overall level of liquid remains relatively constant in the vessel 1. A gas 5 is introduced to the vessel 1 and the mixing of the gas and liquid additive with the mixing media 2 (which could be steel wool for example) causes the liquid additive to evaporate and partition into the carrier gas. Preferably the gas is saturated with the additive vapor which can be controlled by varying the path length the carrier gas travels through the solution. The saturated gas/vapor then is moved through the vessel into the vapor distributor 6, which distributes the saturated gas/vapor to the moving coating surface. The vapor distributor is designed and positioned such that a uniform cloud of vapor comes in contact with the coating.

As the wet coated surface conveys through the gas/vapor, the additive in the vapor will diffuse to the surface (and or through the coating) and react with the coating. A shield or cover encapsulates the area of the vapor such that the vapor is contained to the wet coating region. The existing vaporizing equipment is commonly used to generate a solvent-only enriched environment near the coating bead. The vaporizer slows down the rate of evaporation of coating solution at the point of application. Using this vaporizer to apply an additive (i.e. crosslinking agent) is unique. Using a crosslinking agent in other application techniques (either in the polymer layer or by applying a separate layer) pose problems, such as: clogged drain lines from unwanted crosslinking of the coating solution in the waste stream, streaks generated due to operational complications (crosslinked polymer on hopper lip or in hopper slot, splices and splashing), and variable coating solution viscosity as the crosslinker reacts with the polymer in the coating.

The advantages from the use of a vapor instead of atomized droplets are that the use of a vapor will prevent surface disruptions (defects) that are problematic with the Fuji patent and it allows fast reacting additives to be added to the wet coated surface, unlike the Agfa patent.

Additives that may be used in this invention include any reactive material that can form a vapor or have a vapor pressure such that they can be transported with an inert gas such as nitrogen or argon (with or without heat applied to maintain the additive in the vapor phase). The choice of the type of reactive material or crosslinking agent will depend on the type of binder material in the coating to which the vapor is applied. For hydroxy containing binders such as polyvinyl butyral or polyvinyl alcohol, any crosslinking agent that reacts with the binder and can be vaporized may be used. Examples of crosslinking agents include anhydrides, isocyanates, blocked isocyanates, epoxides, aziridines, melamine-formaldehydes and metal alkoxides, such as trimethoxy silane, titanium methoxide and derivatives thereof. In particular, boron-alkoxides, such as trimethylborate are preferred.

A fast-acting reactive additive which is particularly useful in the present invention is a hardening agent such as trimethylborate, triethoxyborate or the like although other hardening agents may be used as long as they are capable of being vaporized.

More particularly, suitable hardening agents to which this invention is applicable include inorganic and organic hardening agents, for example, aldehyde group containing compounds (e.g., formaldehyde, glyoxal, glutaraldehyde, etc.), N-methylol compounds (e.g. dimethylolurea, methyloldimethylhydantoin, etc.), activated vinyl compounds (e.g., 1,3,5-triacyloyl-hexahydro-s-triazine, bis-(vinylsulfonyl)methyl ether, etc.), activated halogen compounds (e.g., 2,4-dichloro-6-hydroxy-s-triazine, etc.), etc. These hardening agents can be used alone or as combinations thereof. Specific examples of such compounds are disclosed in U.S. Pat. Nos. 1,870,354; 2,080,019; 2,726,162; 2,870,013; 2,983,611; 2,992,109; 3,047,394; 3,057,723; 3,103,437; 3,321,313; 3,325,287; 3,362,827; 3,539,644; and 3,543,292; British Patent Nos. 676,628; 825,544; and 1,270,578; West German Patent Nos. 872,153 and 1,090,427 and Japanese Patent Publication Nos. 7133/1959 and 1872/1971.

Other examples of useful additives are antistatic agents, lubricants, surface-active agents, and ultraviolet light absorbents.

Specific examples of nonionic surface active agents include saponin, alkylene oxide derivatives (for example; glycidol derivatives, fatty acid esters of polyhydric alcohols, alkylesters of sucrose, urethanes or ethers of sucrose; anionic surface active agents containing carboxy, sulfo, phospho or sulfate ester groups; amphoteric surface active agents such as aminoacids; aminoalkylsulfonic acids, aminoalkylsulfuric acid or phosphoric acid esters, alkylbetaines, amineimides, amine oxides; catonic surface active agents such as alkylamine.

Examples of surface active agents are specifically disclosed in U.S. Pat. Nos. 2,240,472; 2,831,766; 3,158,484; 3,210,191; 3,294,540; and 3,507,660; British Patent Nos. 1,012,495; 1,022,878; 1,179,290; and 1,198,450; Japanese Patent Application Nos. (OPI) 117414/1975 and 59025/1975; U.S. Pat. Nos. 2,739,891; 2,823,123; 3,068,101; 3,415,649; 3,666,478; 3,756,828; 3,133,816; 3,441,413; 3,475,174; 3,545,974; 3,726,683; 3,843,368; 2,271,623; 2,288,226; 2,944,900; 3,253,919; 3,671,247; 3,772,021; 3,589,906; 3,666,478; and 3,754,924; British Patent Nos. 1,397,218; 1,138,514; 1,159,825 and 1,374,780; West German Patent Application No. (OLS) 1,961,638; Belgian Patent No. 731,126 and Japanese Publication Nos. 378/1965, 379/1965 and 13822/1968.

The additive can preferably be added along with a solvent for the additive. The solvent must be vaporizable. Useful solvents for trimethylborate and the like are acetone, 2-butanone, and dichloromethane. To be useful, the solvent must only be compatible with the additive.

The composition of the additive-solvent system to be vaporized can be 0.1 to 100 weight percent additive. Vaporization temperatures for the additive alone or these mixtures are typically from 15 to 30° C.

Suitable supports which can be used in this invention include films comprising a semisynthetic or synthetic polymers such as nitrocellulose, cellulose acetate, cellulose acetate butyrate, polystyrene, polyvinyl chloride, polyethylene terephthalate, polyethylene naphthalate, polycarbonates, etc. and papers coated or laminated with a baryta layer or an olefin $\alpha$-polymer such as polyethylene, polypropylene, an ethylene/butene copolymer. The supports may be colored with dyes and/or pigments or rendered light intercepting. The surface of the supports are usually coated with a subbing layer to improve adhesion of the photographic or thermographic emulsion layer. Further, the surface of the supports may be treated using a corona discharge, glow discharge, ultraviolet radiation, a flame treatment, before or after the under coating process.

Useful coating compositions to which the vaporized additive is added include imaging coating compositions such as gelatin-silver halide photographic emulsions, polyvinybutyral-organic silver salt based (photo) thermographic emulsions, protective overcoats such as those based on polyvinylalcohol, and the like.

The coating compositions used can be wet or dry. In some instances, the coating composition must be wet in order for a reaction to occur between the additives and ingredients in the coating composition. Some additives will react with the coating's ingredients while dried.

Once the desired coated amount has been achieved suitable drying conditions which can be used are with temperatures of about 20° C. to about 50° C. and a relative humidity of about 50 to 70%, with a stream of e.g., air at a velocity of about 1 to about 30 m/sec at the surface of the support or the layer being coated.

The following examples are given to illustrate the invention in greater detail.

EXAMPLES

Comparative Example 1

Sample A, comparison:

A thermally processable imaging element was prepared by coating a blue (0.14 density) poly(ethylene terephthalate) support, having a thickness of 0.178 mm, with a photothermographic imaging layer and a protective overcoat. The layers of the thermally processable imaging element are coated on a support using an X-hopper, with a 11 cm wide slot in this example. The photothermographic imaging composition was coated at 200 ft/min from a solvent mixture containing 73.5% 2-butanone, 11.0% toluene, 15% methanol and 0.5% Dowanol (2-phenoxyethanol) at a wet coverage of 43 cc/m$^2$ to form an imaging layer of the following dry composition:

TABLE 1

Photothermographic Imaging Layer

| Components | Dry Coverage (g/m$^2$) |
|---|---|
| Succinimide | 0.072 |
| Phthalimide | 0.286 |
| Poly-dimethyl siloxane (General Electric SF-96-200) | 0.003 |
| 2-bromo-2-((4-methylphenyl)sulfonyl)acetamide | 0.052 |
| Naphthyl triazine | 0.013 |
| Palmitic acid | 0.063 |
| N-(4-hydroxyphenyl)-benzenesulfonamide | 0.858 |
| Silver, as silver bromide | 0.230 |
| B-15708 sensitizing dye | 0.002 |
| Silver, as silver behenate | 4.686 |
| Polyvinyl butyral, M.W. 90,000–120,000 (Monsanto Butvar B-76, 11–13% hydroxyl content) | 3.575 |
| Mercury, as mercuric bromide | 0.001 |
| Chlorowax 65, a chlorinate paraffin from OxyChem | 0.358 |
| Sodium Iodide | .0002 |

The resulting imaging layer was then overcoated with mixture of polyvinyl alcohol and hydrolyzed tetraethyl orthosilicate as described in Table 2 at a wet coverage of 40.4 g/m$^2$ and dried.

TABLE 2

Overcoat Solution

| Component | Grams |
|---|---|
| Distilled Water | 226.4 |
| Polyvinyl Alcohol (PVA, Elvanol 52-22 from DuPont, 86–89% hydrolyzed) (6.2% by weight in distilled water) | 443.0 |
| Tetraethyl Orthosilicate (35.4% by weight in methanol/water (53:47)) | 251.6 |
| p-Toluene Sulfonic Acid (1N solution in distilled water) | 3.1 |

TABLE 2-continued

Overcoat Solution

| Component | Grams |
|---|---|
| Olin 10G (10% by weight in distilled water. (Olin 10G is para-isononylphenoxy polyglycidol and is a trademark of and available from the Olin Corp., U.S.A.) | 10.0 |
| Silica (1.5 micron) | 3.0 |

EXAMPLES 1 AND 2

The samples B and C of Examples 1 and 2 were prepared in a similar manner as Sample A, except that a vapor of trimethyl borate (TMB) which is a cross linking hardener was applied to the wet layer directly at the point of coating. To form the vapor, nitrogen gas is bubbled through a closed container of TMB. The nitrogen gas becomes saturated with TMB and this vapor is directed to the coating by passing the vapor through a 11 cm long perforated tube which is located at the hopper. The flow rate of the gas was varied to control the amount of vapor applied to the web.

Samples A–C were evaluated for the amount of crosslinker applied and the effectiveness using two methods described below.

Wt % TMB: To determine the amount of TMB in the coatings, a piece of the coated emulsion before the application of the overcoat was analyzed using Dynamic Secondary Ion Mass Spectroscopy. D-SIMS. Using a calibration curve (prepared by analyzing coatings with known amounts of the TMB in the emulsion layer), the wt % of TMB in samples could then determined.

Penetration: Effectiveness of Crosslinker: Penetration test—To measure thermal penetration a 1 cm×1 cm sample is cut and placed on the sample stage (emulsion side up) of a TA Instruments TMA 2940 Thermomechanical Analyzer, with a 2.8 mm diameter expansion probe installed and nitrogen purge gas used. A 1 Newton load is applied to the sample and the sample is then allowed to equilibrate at 30° C. The temperature is ramped at 10° C./min. to 130° C. and the deflection of the probe is recorded as a function of temperature. The amount of penetration into the sample is calculated by taking the difference between the probe depth at 130° C. and the maximum probe deflection due to thermal expansion. The lower the value, the more resistant the sample is to deformation at elevated temperatures, which represents a higher degree of crosslinking.

TABLE 3

| Example | Nitrogen flow (scfh) | Wt % TMB in dry coating | Penetration ($\mu$m) |
|---|---|---|---|
| A-comparison | 0 | 0 | 3.22 |
| B - 1 | 4 | 0.35 | 1.35 |
| C - 2 | 12 | 2.00 | 1.15 |

These results demonstrate that the TMB can be applied to the emulsion as a vapor and effectively crosslink the layer. The amount of TMB in the emulsion can be varied by controlling the nitrogen flow rate. The flow rate required to obtain a given TMB concentration in the coating will vary depending on the width of the perforated tube, vapor bar, used to direct the vapor to the coating. The D-SIMS data used to determine wt% TMB also show that the TMB is uniformly distributed throughout the thickness of the emulsion layer.

EXAMPLE 3

Samples D through J were prepared in a similar manner as those in examples 1 and 2 but the concentration of the TMB in the transport gas was varied by either changing the nitrogen flow rate or the concentration of the TMB in the closed container (using 2-butanone to form the TMB solution), see Table 5 for details.

For these samples the photothermographic imaging composition was coated from a solvent mixture containing 73.5% 2-butanone, 11.0% toluene, 15% methanol and 0.5% Dowanol at a wet coverage of 39 cc/m$^2$ to form an imaging layer of the following dry composition:

TABLE 4

| Photothermographic Imaging Layer | |
|---|---|
| Components | Dry Coverage (g/m$^2$) |
| Succinimide | 0.072 |
| Phthalimide | 0.286 |
| Poly-dimethyl siloxane (General Electric SF-96-200) | 0.003 |
| 2-bromo-2-((4-methylphenyl)sulfonyl)acetamide | 0.052 |
| Naphthyl triazine | 0.013 |
| Palmitic acid | 0.063 |
| N-(4-hydroxyphenyl)-benzenesulfonamide | 0.858 |
| Silver, as silver bromide | 0.230 |
| B-15708 sensitizing dye | 0.002 |
| Silver, as silver behenate | 4.686 |
| Polyvinyl butyral, M.W. 90,000–120,000 (Monsanto Butvar B-76, 11–13% hydroxyl content) | 2.574 |
| Mercury, as mercuric bromide | 0.001 |
| Sodium Iodide | .0002 |

The samples were evaluated for the amount of TMB in the dried coating and crosslinking using the methods described in examples 1 and 2. The results are reported in Table 5.

TABLE 5

| Sample | % TMB in Bubbler | Nitrogen flow (scfh) | Web speed (ft/min) | Wt % TMB, dried coating | Penetration (μm) |
|---|---|---|---|---|---|
| D | 6.25 | 12 | 200 | 0.80 | 0.90 |
| E | 12.5 | 12 | 200 | 0.41 | 0.53 |
| F | 25.0 | 12 | 200 | 0.47 | 0.04 |
| G | 50.0 | 12 | 200 | 3.67 | 0.02 |
| H | 100.0 | 12 | 200 | 7.14 | not tested |
| I | 25.0 | 12 | 400 | 0.18 | 0.51 |
| J | 25.0 | 24 | 400 | 0.14 | 0.14 |

These results show that the amount of TMB applied to the coating can be altered by varying the process conditions.

EXAMPLES 4 AND 5

Samples K–M, were prepared as described in Examples 1 and 2 except now two layers of the photothermographic imaging layer were applied with 2 separate coating passes. For these coatings, 100% TMB was used in the bubbler with a nitrogen flow rate of 8 scfh. The amount of TMB in the coating was determined using D-SIMS with results in Table 6.

TABLE 6

| Sample | Coating Pass | TMB Vapor Applied | Wt. % TMB in final coating |
|---|---|---|---|
| K, comparison | 1 | No | |
| | 2 | No | 0 |
| L, (Example 4) | 1 | No | |
| | 2 | Yes | 0.93 |
| M, (Example 5) | 1 | Yes | |
| | 2 | Yes | 1.29 |

EXAMPLE 6

Samples N–P were prepared in a similar manner as described in Examples 1 and 2. For these samples, the photothermographic imaging composition was coated from a solvent mixture containing 57 parts by weight methylethylketone, 27 parts toluene, 9 parts by weight methyl isobutyl ketone and 7 parts by weight acetone at 54.5 cc/ft$^2$, 500 fpm to form an imaging layer of the following dry composition:

| Component | Dry Coverage (g/m$^2$) |
|---|---|
| Silver behenate | 1.072 |
| AgBr | 0.193 |
| Succinimide | 0.250 |
| *Surfactant | 0.006 |
| 2-bromo-2-p-tolysulfonyl acetamide | 0.070 |
| 2,4-bis(trichloromethyl)-6-(1(-naphtho)-S-triazine | 0.017 |
| sensitizing dye | 0.006 |
| 4-benzenesulfonamidophenol | 1.129 |
| **binder | 4.678 |

*a polysiloxane fluid available under the trademark SF-96 from General Electric Company
**a poly(vinylbutyral) available under the trademark Butvar 76 resin from Monsanto Company The TMB was applied as a vapor (100% TMB in bubbler, nitrogen flow of 16 scfh). After coating the emulsion, the samples were evaluated for amount of TMB incorporated in the layer using D-SIMS, see Table 7.

TABLE 7

| Sample | Application of TMB | Wt % TMB in dried layer |
|---|---|---|
| N, comparison | none | 0 |
| P, (Example 6) | as a vapor | 0.99 |

This shows that the vapor application method can apply the same level of TMB to the coating as with a conventional method (sample N) which suffers from coating streaks and width-wide crosslines from the application method. A decrease in coating non-uniformities such as air flow induced mottle using the vapor application method compared to the slide was an additional benefit of the vapor application method.

The invention has been described in detail with particular reference to certain preferred embodiments thereof, but it will be understood that variations and modifications can be effected within the spirit and scope of the invention.

| PARTS LIST |
|---|
| 1 Jacketed vessel |
| 2 Mixing media |
| 3 Liquid Additive |
| 4 Additive supply line |
| 5 Gas Supply |
| 6 Vapor Distributor |

What is claimed is:

1. A process for adding additives to a photographic or photothermographic coating material on a support comprising the steps of:

(a) introducing a carrier gas to a liquid additive causing a portion of the liquid additive to vaporize to yield a mixture of the carrier gas and the vaporized additive;

(b) applying the mixture of the carrier gas and the vaporized additive to the photographic or photothermographic coating material.

2. A process as recited in claim 1 wherein:

the additive is selected from the group consisting of: cross-linking agents, reactive agents, surface active agents, lubricants, and UV light absorbants.

3. A process as recited the 8 in claim 1 wherein:

the silver halide coating material is on a moving support.

4. A process as recited in claim 1 wherein:

the carrier gas is nitrogen.

5. A process as recited in claim 1 wherein:

the additive is trimethyl borate.

6. A process for adding additives to a photographic or photothermographic coating material on a moving support surface comprising the steps of:

(a) generating a uniform vapor cloud of an additive;

(b) contacting a photographic or photothermographic coating material with the uniform vapor cloud.

7. A process as recited in claim 6 wherein:

the additive is selected from the group consisting of: cross-linking agents, reactive agents, surface active agents, lubricants, and UV light absorbants.

8. A process as recited in claim 6 wherein said generating step is performed by:

introducing a carrier gas to a liquid additive causing a portion of the liquid additive to vaporize to yield a mixture of the carrier gas and the vaporized additive, the uniform vapor cloud being comprised of the mixture.

9. A process as recited in claim 6 wherein:

the carrier gas is nitrogen.

10. A process as recited in claim 6 wherein:

the additive is trimethyl borate.

* * * * *